US006890156B2

(12) United States Patent
Watson et al.

(10) Patent No.: US 6,890,156 B2
(45) Date of Patent: May 10, 2005

(54) RECIPROCATING PUMP CONTROL SYSTEM

(75) Inventors: Jeff Watson, Edmonton (CA); Ramesh Aggarwal, Edmonton (CA); Hari Upadhyay, Edmonton (CA)

(73) Assignee: Polyphase Engineered Controls, Edmonton (CA)

( * ) Notice: Subject to any disclaimer, the term of this patent is extended or adjusted under 35 U.S.C. 154(b) by 33 days.

(21) Appl. No.: 10/286,180

(22) Filed: Nov. 1, 2002

(65) Prior Publication Data

US 2004/0084179 A1 May 6, 2004

(51) Int. Cl.[7] ..... F04B 49/06
(52) U.S. Cl. ..... 417/42; 417/44.1; 417/53
(58) Field of Search ..... 417/42, 44.1, 45, 417/53, 326, 410.1, 415; 166/250.15

(56) References Cited

U.S. PATENT DOCUMENTS

| | | | | |
|---|---|---|---|---|
| 4,102,394 A | | 7/1978 | Botts | |
| 4,145,161 A | | 3/1979 | Skinner | |
| 4,599,046 A | * | 7/1986 | James | 417/44.1 |
| 4,661,751 A | * | 4/1987 | Werner | 417/12 |
| 4,854,164 A | * | 8/1989 | Rhoads | 73/152.29 |
| 4,971,522 A | | 11/1990 | Butlin | |
| 5,246,076 A | | 9/1993 | Watson | |
| 5,251,696 A | | 10/1993 | Boone et al. | |
| 5,252,031 A | * | 10/1993 | Gibbs | 417/53 |
| 5,281,100 A | | 1/1994 | Diederich | |
| 5,441,389 A | | 8/1995 | Wolcott et al. | |
| 5,782,608 A | * | 7/1998 | McKee | 417/43 |
| 5,820,350 A | * | 10/1998 | Mantey et al. | 417/45 |
| 6,343,656 B1 | | 2/2002 | Vazquez et al. | |
| 6,629,570 B1 | * | 10/2003 | Head | 175/61 |

FOREIGN PATENT DOCUMENTS

WO WO 03/048578 A1 6/2003

OTHER PUBLICATIONS

U.S. Appl. No. 09/749,303, filed Sep. 5, 2002, Chan et al.
Lufkin Industries Inc., "Lufkin—Pumping Units" Composite Catalogue, reprinted from 43rd (1998–99), Lufkin, Texas.

* cited by examiner

*Primary Examiner*—Michael Koczo, Jr.
(74) *Attorney, Agent, or Firm*—Bennett Jones LLP

(57) ABSTRACT

A pumpjack speed control system includes a user interface, a controller and a variable speed drive. The user interface includes a mathematical representation of the pumpjack geometry which permits the conversion of rod speed profiles to crank speed profiles.

14 Claims, 9 Drawing Sheets

| | Pos | Spd | Acc |
|---|---|---|---|
| 1 | 0.00 | 50.00 | 20.00 |
| 2 | 150.00 | 30.00 | 15.00 |
| 3 | 340.00 | 50.00 | 20.00 |
| 4 | 360.00 | 50.00 | 20.00 |
| 5 | | | |

RECIPROCATING PUMP CONTROL SYSTEM

FIELD OF THE INVENTION

The present invention relates to a system for varying the speed of a rotationally-actuated, reciprocating pump. More particularly, it relates to a method and apparatus for controlling the intra-cycle rod speed of a pumpjack.

BACKGROUND OF THE INVENTION

Reciprocating pumps such as pumpjacks are typically operated with a fixed motor speed during a revolution of the crank arm. The speed, acceleration and position of the linear motion applied to the rod string at the horsehead are determined by the speed, acceleration and position of the crank arm and the geometry of the pumpjack. The geometry of a typical pumpjack is depicted in FIG. 1. Conventional operation of a pumpjack is to maintain a constant crank speed. As a result, the geometry of the pumpjack dictates a rod speed which follows a curve which is sinusoidal in nature.

Adjustments to optimize well production have historically involved changing the geometry of the pump or by increasing or decreasing the overall rotational velocity of the crank. Within a cycle, crank speed typically remains fixed and the dynamics of the pump are determined by the geometry.

Methods have been implemented where the speed has been varied within the stroke to generally increase the speed during the upstroke to maximize efficiency and decrease the speed on the downstroke to eliminate pounding against fluid columns. For example, in U.S. Pat. No. 4,102,394, a control system for a variable speed electric motor used to power a pumpjack is disclosed. The control system is said to allow for greater upstroke speed versus downstroke speed and to vary the stroke frequency in response to oil levels in the well and in storage facilities. However, no detailed disclosure of the control system is provided. As well, the system does not allow for customized speed profiles to be implemented.

Therefore, there is a need in the art for a control system, including methods and apparatuses, for allowing convenient and complete control of crank speed and rod velocity within a stroke cycle.

SUMMARY OF THE INVENTION

In general terms, the invention comprises a speed control system for a rocking beam pump that is driven by an electric or internal combustion motor. The system enables a user to control the dynamics of the pumping process by adjusting to compensate for the geometry of the pumping unit. In essence, the dynamics and motion of the rod string are decoupled from the pumping unit geometry. The system includes electrical and electronic hardware, numerical methods, software algorithms and user interface designs to enable the control of the pumping unit and speed profiles designed to control rod motion and dynamics while compensating for the specific geometry of the pumping unit used.

In one aspect, the invention may comprise a control system for varying the rod speed of a pumping unit having a geometry and comprising a variable speed motor and rotating crank arm, the system comprising:

(a) a variable frequency drive for providing a speed setpoint to the motor;

(b) a controller operatively connected to the variable frequency drive comprising means for outputting a speed setpoint in accordance with a crank speed profile; and (c) a processor comprising means for creating a crank speed profile and communicating the crank speed profile to the controller.

The system preferably further comprises a memory including a mathematical representation of the pumping unit geometry and wherein the processor further comprises means for creating a rod speed profile and means for converting a rod speed profile to a crank speed profile.

In another aspect, the invention may comprise a method of controlling the rod speed of a pumping unit having a geometry and comprising a variable frequency drive, a variable speed motor and a rotating crank arm, the method comprising the steps of:

(a) creating a mathematical model of the pumping unit geometry;

(b) receiving from a user a rod speed profile or a crank speed profile;

(c) converting a rod speed profile to a crank speed profile using the mathematical model, if a rod speed profile is received; and (d) outputting a speed setpoint to the variable frequency drive in accordance with the crank speed profile.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

The present invention provides for a speed control system for a walking beam pumping unit that is driven by an electric or internal combustion motor. When describing the present invention, all terms not defined herein have their common art-recognized meanings.

Figure 1:
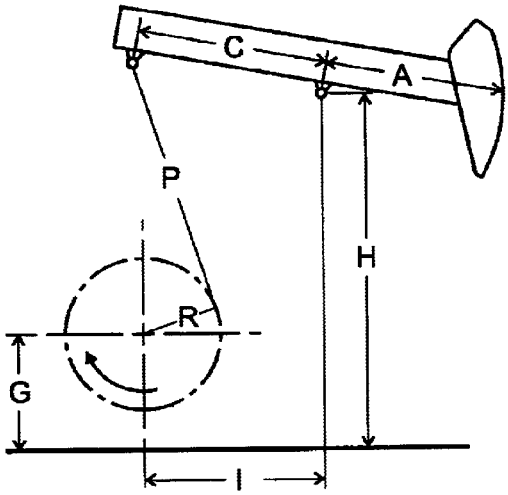
FIG. 1 (Prior Art)
FIG. 1 (prior art) is a schematic representation of the geometry of a conventional pumpjack unit which may implement the method or system of the present invention.

A conventional walking beam pumping unit is shown in FIG. 1. As is well known in the art, the geometry of the pumping unit translates rotational motion of the crank arm to vertically linear reciprocating motion of the polished rod and the sucker rods. The geometry of the pumping unit is determined by the measurements of the distances indicated by A, C, P, R, G and H shown in FIG. 1. As used herein, a single pumping cycle of such a pumping unit is defined by one complete revolution of the crank arm. A single pumping cycle may be deemed to start at a point where the rod string has reached its lowest point and continues as the rod string ascends, reverses and decends back to its starting position. Assuming a constant crank speed, rod speed will follow a curve sinusoidal in nature, reaching zero at the highest and lowest points of rod travel and accelerating to reach maximum velocity there between, as shown in FIG. 2.

In order to convert rotational crank speed, typically measured in degrees per second, into linear rod speed, typically measured in metres per second, the dimensions and configuration of various components of the pumping unit must be known. This is referred to herein as the geometry of the pumping unit and may be expressed mathematically to arrive at equations which convert rod speed into crank speed. The derivation of such a mathematical model of any given pumping unit geometry is well within the skill of one skilled in the art.

Figure 2:
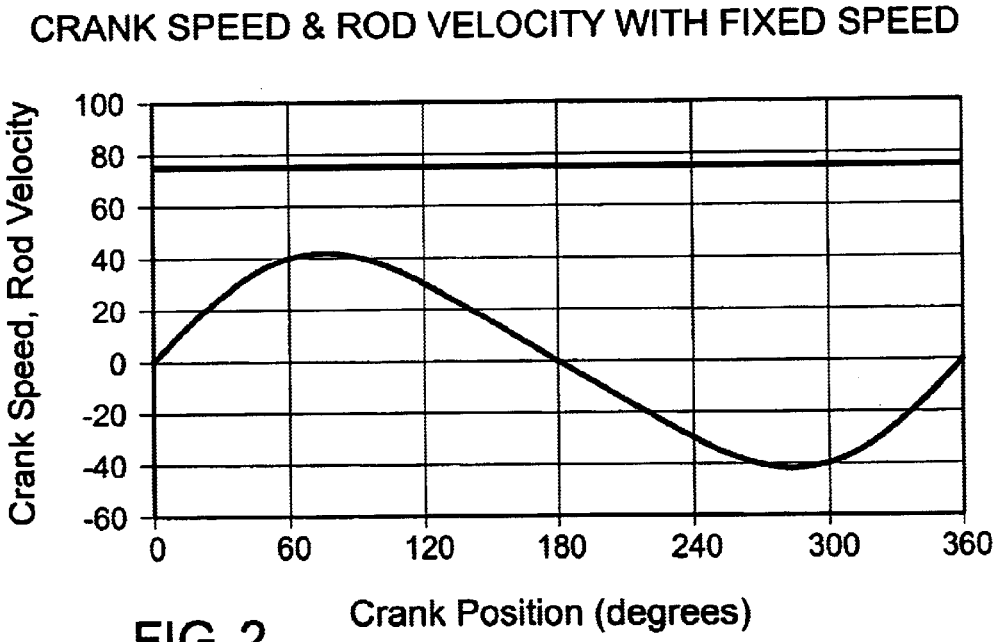
FIG. 2 (Prior Art)
FIG. 2 is a graphical representation of a conventional constant crank speed profile and a sinusoidal rod speed profile.

As used herein, a speed profile is a set of speed values over the range of a single pumping cycle and may be depicted graphically as shown in FIG. 2. In FIG. 2, the crank speed profile (CSP) is a flat line, indicating a constant crank speed throughout the cycle. The rod speed profile (RSP) therefore is a curve of sinusoidal nature. As one skilled in the art will realize, any variation of the crank speed translates to a variation of the rod speed. As well, changes from one speed value to another during a cycle do not occur instantaneously, therefore a speed profile will slope upwards or downwards between speed values, indicating periods of acceleration or deceleration.

Figure 3:
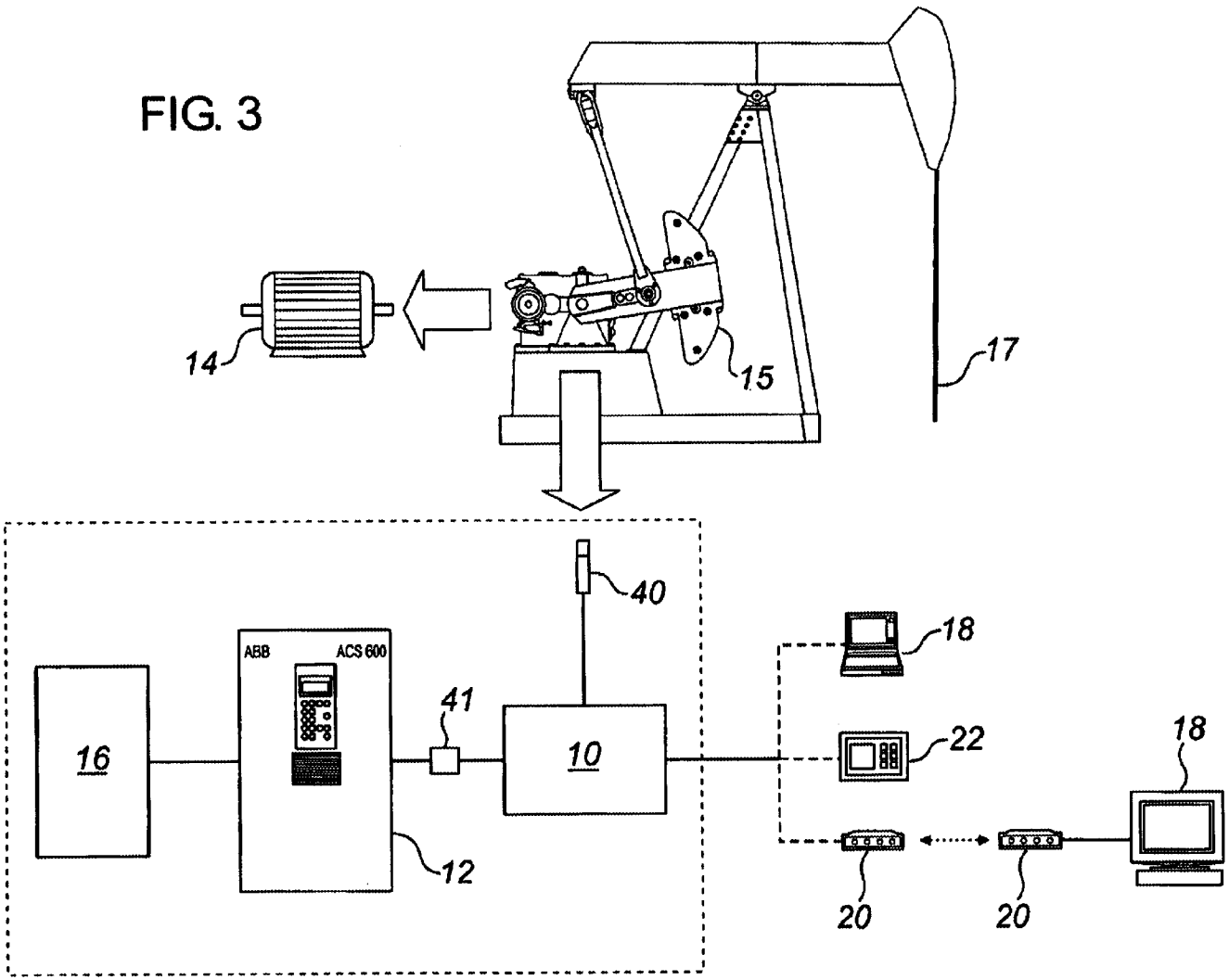
FIG. 3 is a schematic representation of one embodiment of a pumpjack speed control system.

In one embodiment, the invention comprises an apparatus including a controller (10) and a variable speed drive (12), as illustrated in FIG. 3. In use, the crank speed specified by a crank speed profile is applied to a variable speed motor (14) by the controller having a servo motion controller. The motor (14) rotates the crank arm (15) which results in reciprocation of the rod (17). The controller may be implemented in a general purpose computer programmed with appropriate software, firmware, a microcontroller, a microprocessor or a plurality of microprocessors, a digital signal processor or other hardware or combination of hardware and software known to those skilled in the art. The controller will physically control the speed of the motor through the variable speed drive (12). Suitable variable speed drives may be AC or DC and are well known in the art. In one embodiment, the drive may be a commercially available variable frequency AC drive such as an ABE ACS-601 (ABE Industry Oy, Helsinki, Finland) or Allen-Bradley 1336 Impact drive (Rockwell Automation) Milwaukee, Wis., USA). Preferred variable frequency drives allow for accurate control of motor speed and/or torque with or without speed feedback. If present, speed feedback may be provided by a pulse encoder on the motor shaft or by other well-known means. If the motor is a diesel engine, the controller (10)) may operate to open or close a throttle (not shown) to achieve speed control.

A dynamic brake (16) is provided to control an overrunning load during the portion of the cycle where the rod string is falling or being decelerated. Dynamic brakes are well-known in the art of variable speed control systems. In some circumstances, the weight of the rod string is greater than the resistance provided by the viscosity of the fluid in the oilwell and the friction inherent in the pumping unit. Therefore, during the downstroke, the pumping unit creates energy which is imparted to the variable frequency drive through the electric motor. In one embodiment, the dynamic brake comprises a bank of resistor elements as is well-known in the art. Line braking or regenerative drive options may also be implemented.

In one embodiment, the controller (10) is a microprocessor and a user interface (18) is provided by a separate general purpose personal computer (PC) such as a laptop computer which is operatively connected to the controller by suitable digital input/output. In this embodiment, the PC includes a memory which contains the mathematical model of the pumping unit and which includes software which allows a user to input either a crank speed profile or a rod speed profile. If the user defines the crank speed profile, that is used directly to control the crank speed by the controller. If, however, the user defines a rod speed profile, that must be converted to a crank speed profile using the mathematical pumping unit model, which is then used to control the crank speed by the controller.

In another embodiment, the user interface (18) is remotely located and communicates with the controller (10) by standard network communication protocols such as TCP/IP or Ethernet protocols. As shown in FIG. 3, a remote workstation (18) may communicate with the controller via telephone, RF, or satellite modems (20) associated with the workstation (18) and the controller (10). A local display (22) for viewing user defined speed profiles and charting results may be provided where the user interface (18) is provided remotely.

Figure 4:
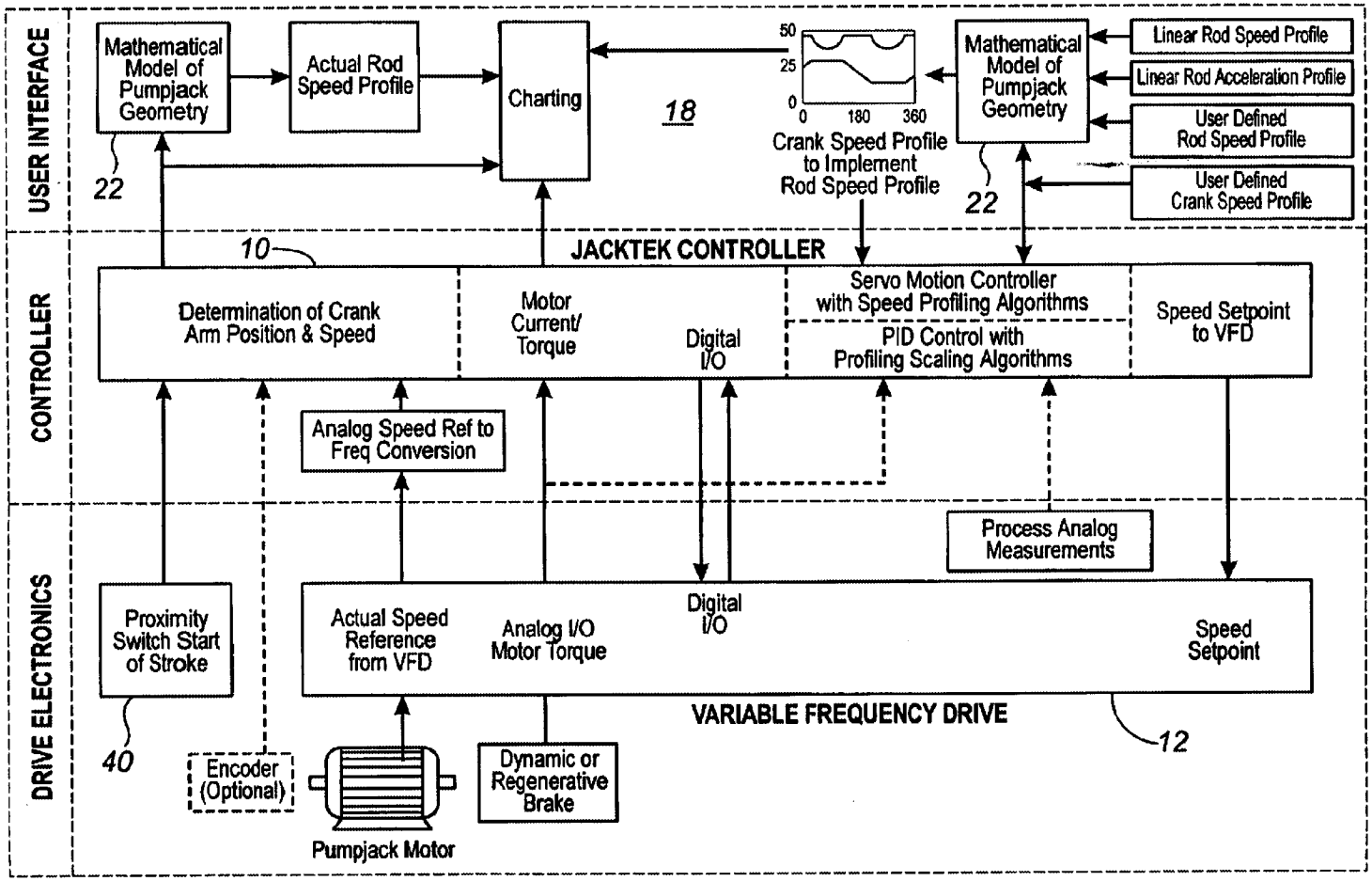
FIG. 4 is block diagram illustrating a schematic representation of the embodiment of FIG. 3.

FIG. 4 shows a schematic representation of one embodiment of the system of the present invention. The controller (10) is implemented separately from the user interface (18) as is shown in FIG. 3. However, in an alternative embodiment, the controller and user interface may also be implemented in a single box such as a general purpose computer. In a preferred embodiment, the user interface is implemented in software running on a general purpose computer while the controller is separately implemented in firmware.

Figure 5:
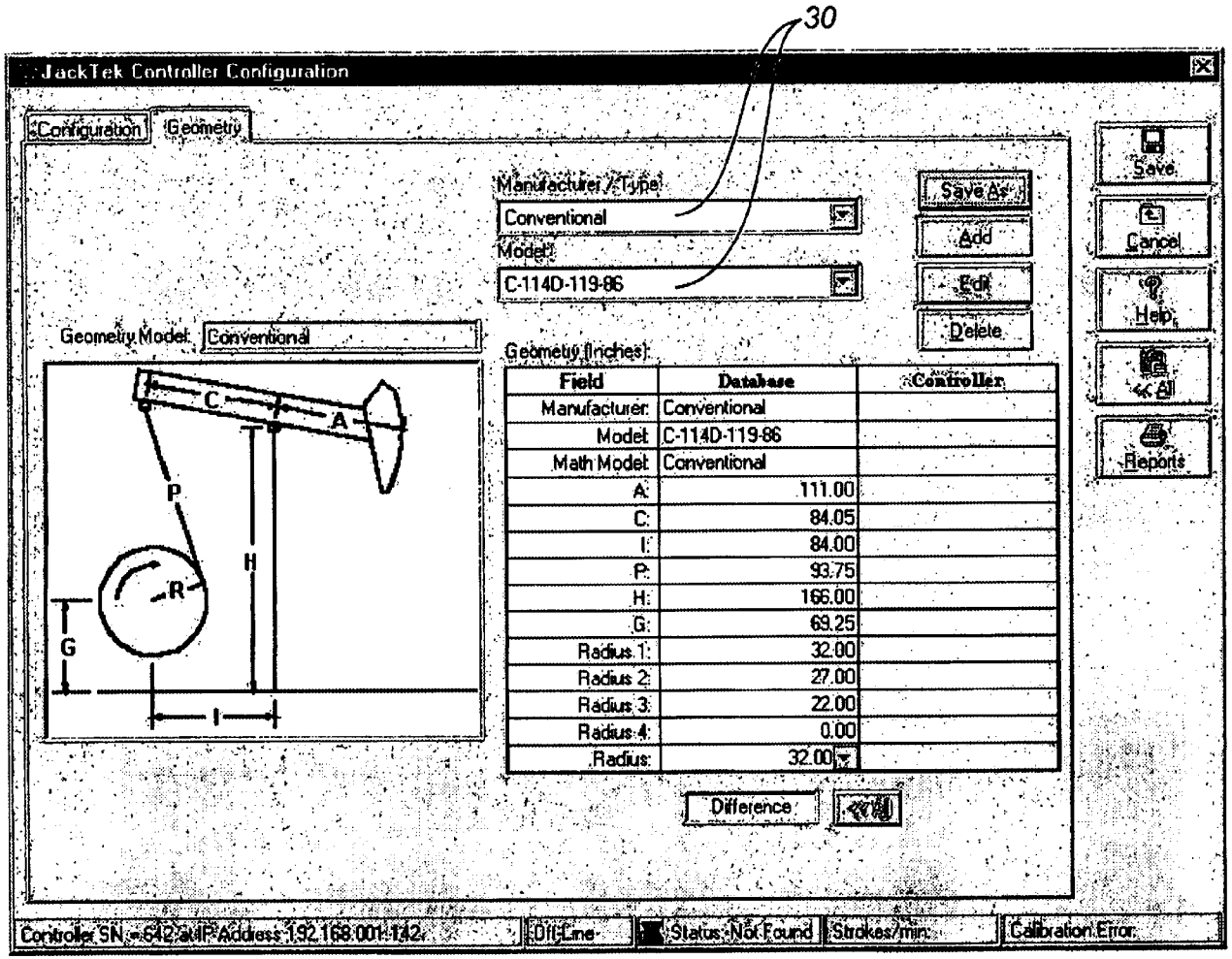
FIG. 5 is a view of a computer software window showing a computer representation of a pumpjack geometry.

The user interface (18) includes a memory (22) where the mathematical model of the pumpjack geometry may be stored. Preferably, the user interface may also include a software module which allows selection of a known math model from a predefined pumpjack geometry or the creation and storage of a new math model. As seen in FIG. 5, the math model may be selected from dropdown menus (30) corresponding to specific models from selected manufacturers. Alternatively, a new math model may be entered or created by entering the relevant values of the pumpjack geometry which may then be stored in the memory and accessed by other modules of the user interface.

The user interface may also include a module which permits the rapid and convenient inputting of a user-defined rod speed profile (RSP) or a crank speed profile (CSP). A user-defined RSP may consist of a plurality of user-defined values such as initial, maximum and terminal upstroke speed and initial, maximum and terminal downstroke speed. The rate of acceleration may also be specified by the user or the user may accept a default value. In one embodiment, one or more profile types may be preconfigured, stored in memory and offered as menu choices. In one embodiment, two types of profiles are linear RSP's and linear CSP's. As will be appreciated by those skilled in the art, a linear or constant RSP may only be the result of an curved CSP. On the other hand, a linear CSP will result in a curved RSP.

Figure 6:
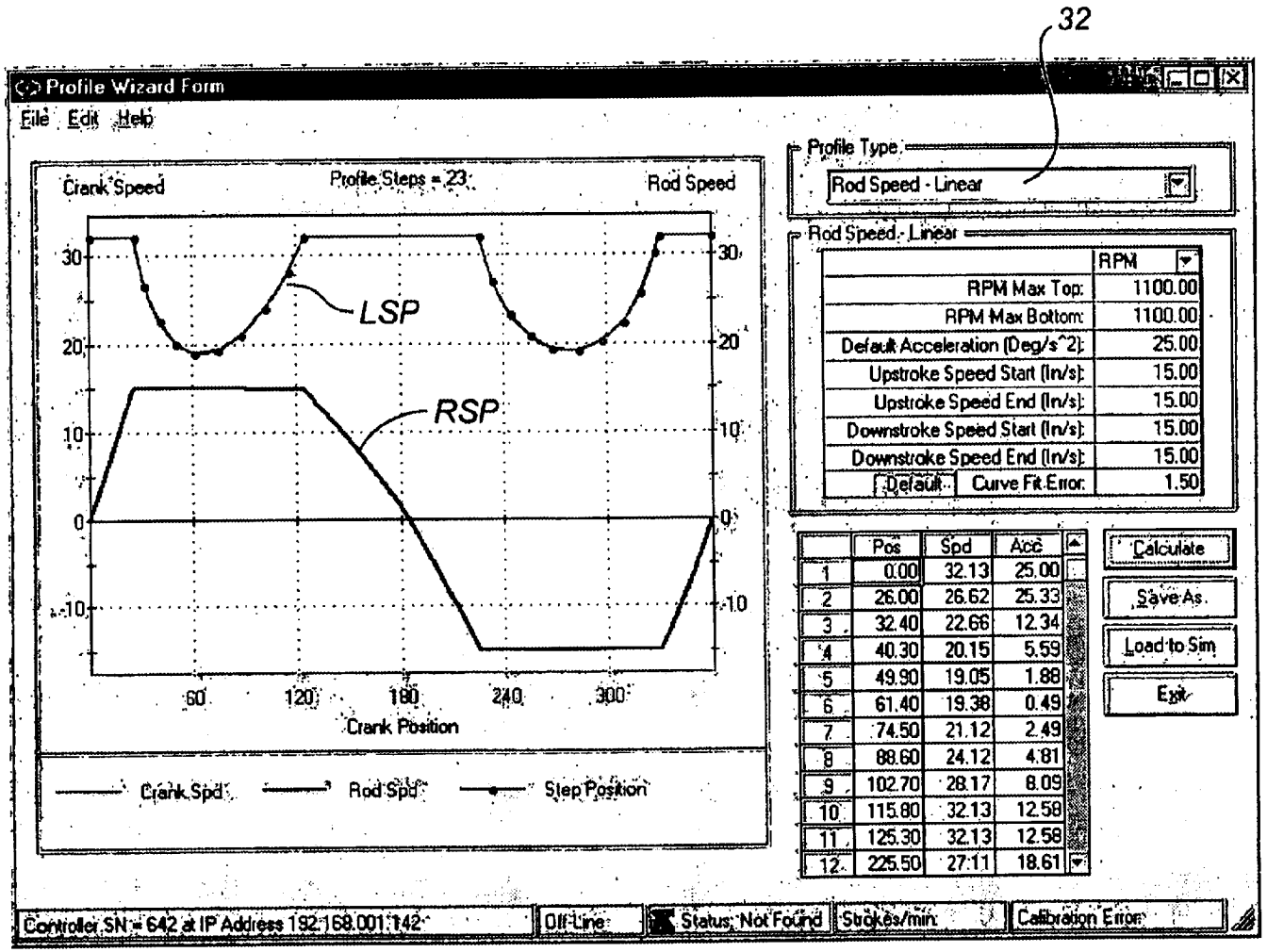
FIG. 6 is a view of a computer software window showing a linear rod speed profile.

FIG. 6 depicts a screen shot of a software window used to define a linear RSP. The profile type is chosen from a dropdown menu (32) at the top right side of the window. As may be seen the rod speed in this example is limited to maximum value during both the upstroke and downstroke and the rate of acceleration or deceleration is relatively linear. As will be apparent to one skilled in the art, such an RSP will require the CSP to include a period of gradual speed decrease and increase, corresponding to the linear maximum rod speed. In this example, the acceleration rate is specified and the upstroke start and end speeds are the same as are the downstroke start and end speeds. The software will then convert the RSP to a CSP and specify a number of profile steps. Each profile step represents a speed change at a specified crank position as well as a crank acceleration value. As shown in FIG. 6, a linear RSP may be converted to a CSP having 23 profile steps. In this example, the rod motion parameters are used to determine the CSP. However, in alternative embodiments, a user may enter a data table of RSP steps each consisting of a rod position and a desired rod speed at that position.

Figure 7:
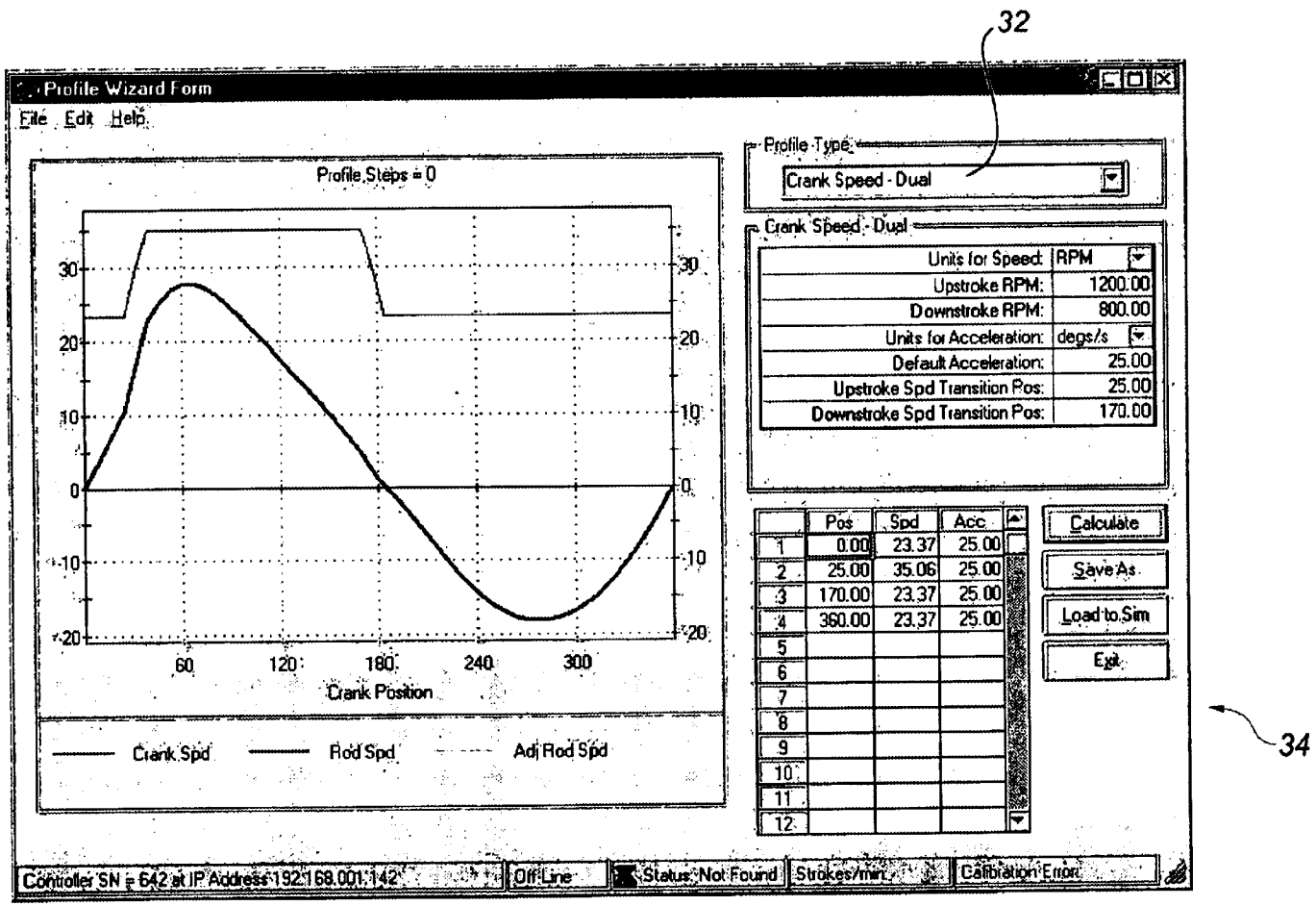
FIG. 7 is a view of a computer software window showing a linear crank speed profile.

FIG. 7 depicts a screen shot of a software window used to define a linear CSP. The profile type (Crank Speed—Dual) is chosen from the profile type dropdown menu (32). This type of CSP may be defined by a user by specifying the desired speed at predetermined points in the cycle. A CSP comprises a series of individual steps where each step consists of the crank position where the desired speed starts, the desired speed and the rate of acceleration. A CSP in the form of a data table having four steps (34) is shown in FIG. 7. The CSP may also be represented graphically as may also be seen in FIG. 7. The data table (34) and graphical representation may be generated by entering values into the data table or by specifying motion parameters such as maximum rotational speed during certain phases within a cycle.

Figure 8:
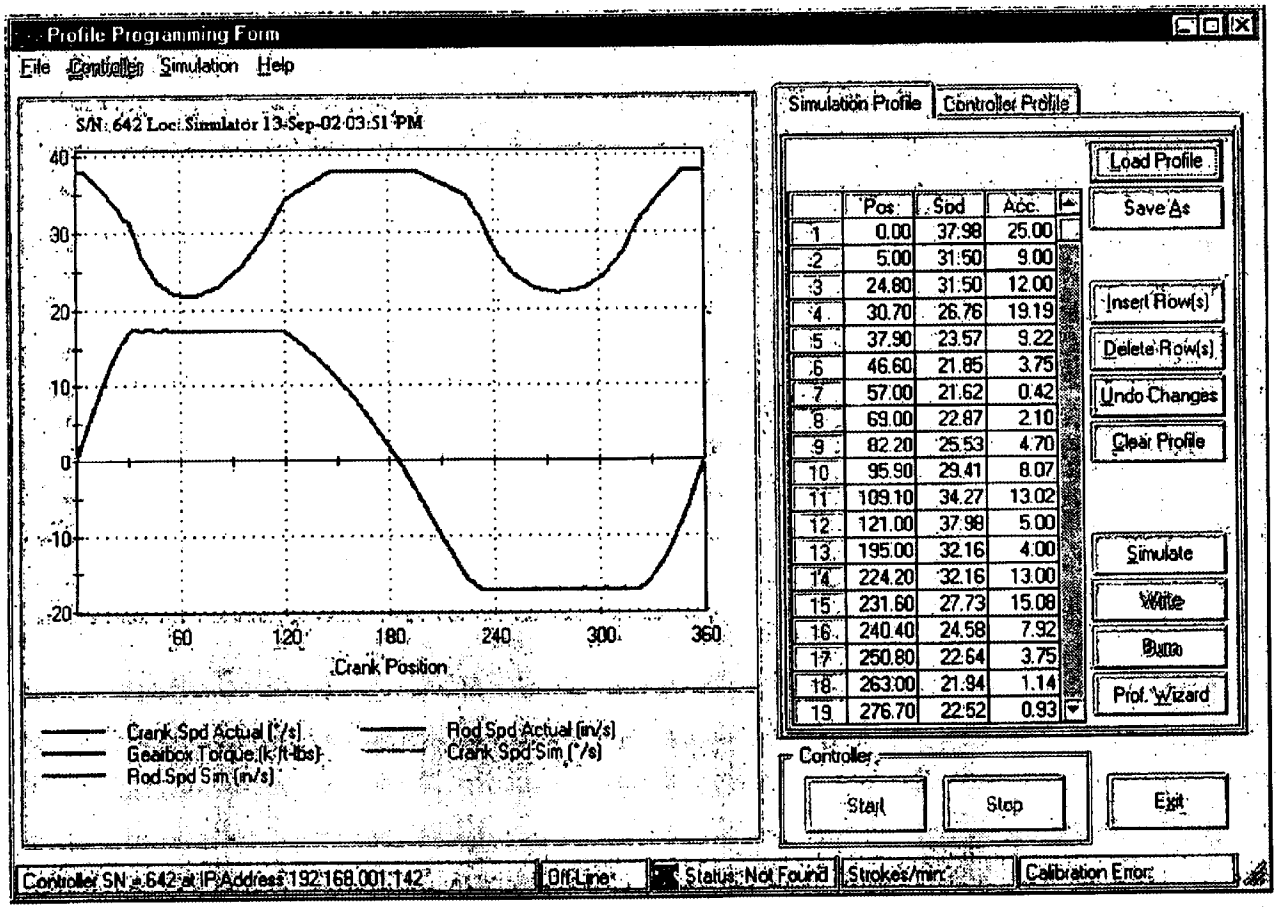
FIG. 8 is a view of a computer software window showing a simulated crank speed profile derived from the linear rod speed profile shown in FIG. 6.

Once a desired CSP or RSP has been defined by the user, the software may provide a simulation function to view the resulting CSP or RSP. FIG. 8 depicts a screen shot of a software window showing the results of a linear RSP (the RSP shown in FIG. 6) simulation. In this case, the RSP has been defined and the user can view graphically and in tabular form, the resulting simulated CSP.

In one embodiment, motor torque or loading on the sucker rod may be monitored using appropriate sensors. It is typically desirable to limit torque or rod loading to certain maximum values to prevent overloading the rod. A proportional integral derivative (PID) control with a scaling algorithm may be provided to adjust the speed control to stay within certain parameters. If measured torque exceeds a set maximum value, the scaling algorithm may be invoked to scale down the speed profile.

In a preferred embodiment, the variable frequency drive produces an actual speed reference, either from monitoring the voltage and current waveforms from the motor or by some other means. The speed reference is used to estimate the crank position at any time during a cycle. In one embodiment, the means for estimating crank position includes a device for producing an analog speed reference and a device for converting the speed reference to square wave pulse train having a frequency proportional to the speed. The speed, as represented by the square wave, may then be integrated to obtain a position of the crank by counting the edges of the square wave as would be done with input from a pulse encoder. In another embodiment, the crank position and speed may be directly measured using a pulse encoder.

Because the crank position is estimated during a cycle or there may be bolt slippage or other errors of a mechanical or electrical nature, it is desirable to provide error correction means. In one embodiment, error correction is provided by resetting the estimated position with actual position once every cycle. This may be accomplished by providing a proximity switch or sensor (40) affixed to a position on the pumping unit whore it may sense the passing of the crank arm and produce an output signal upon the passing of the crank arm. The proximity switch signal may then be used to reset the estimated crank arm position derived from speed/time calculations performed by the controller, at the beginning of each cycle or once per cycle at a specified point during the cycle.

In a preferred embodiment, the actual speed reference may be used to produce real time speed profiles which may be charted and graphically displayed or recorded. Particularly useful may be a real time comparison of the menial speed profile with the user defined speed profile. This charting function may be part of the PC based software in the user interface and may also receive and chart such other data or variables such as motor current or torque. Motor torque may be reported by a torque sensor (41).

In one embodiment, an encoder may be provided to provide an actual crank arm position signal, in which case a proximity switch or other means of error correction may not be necessary, but may still be desirable to correct for mechanical errors such as belt slippage.

An embodiment of the invention in its method form will now be described in reference to FIGS. 9 and 10.

Figure 9:
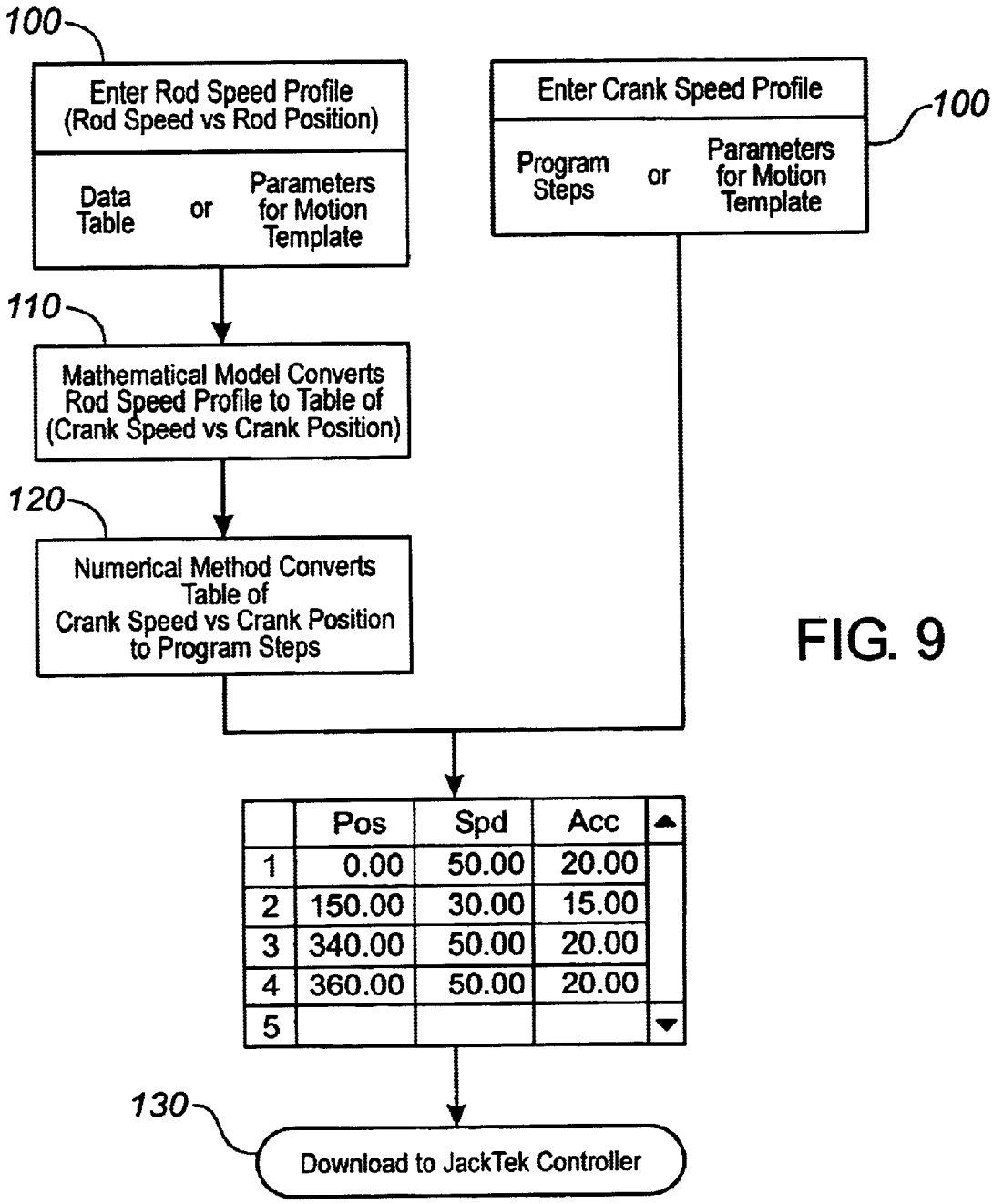
FIG. 9 is a flow diagram of a speed profile entry process.

FIG. 9 is a flowchart presenting the steps involved in creating a series of program steps representing a CSP or a RSP. The first step is to either enter a CSP or a RSP either by entering a data table, program steps or a template of motion parameters (100). If a RSP is entered, it is necessary to convert the RSP values to a CSP (110), which is comprised of a series of crank speed settings in certain crank positions. The CSP table is then converted (120) to a series of program steps which may be downloaded (130) to the controller which is operatively connected to the variable frequency drive.

Figure 10:
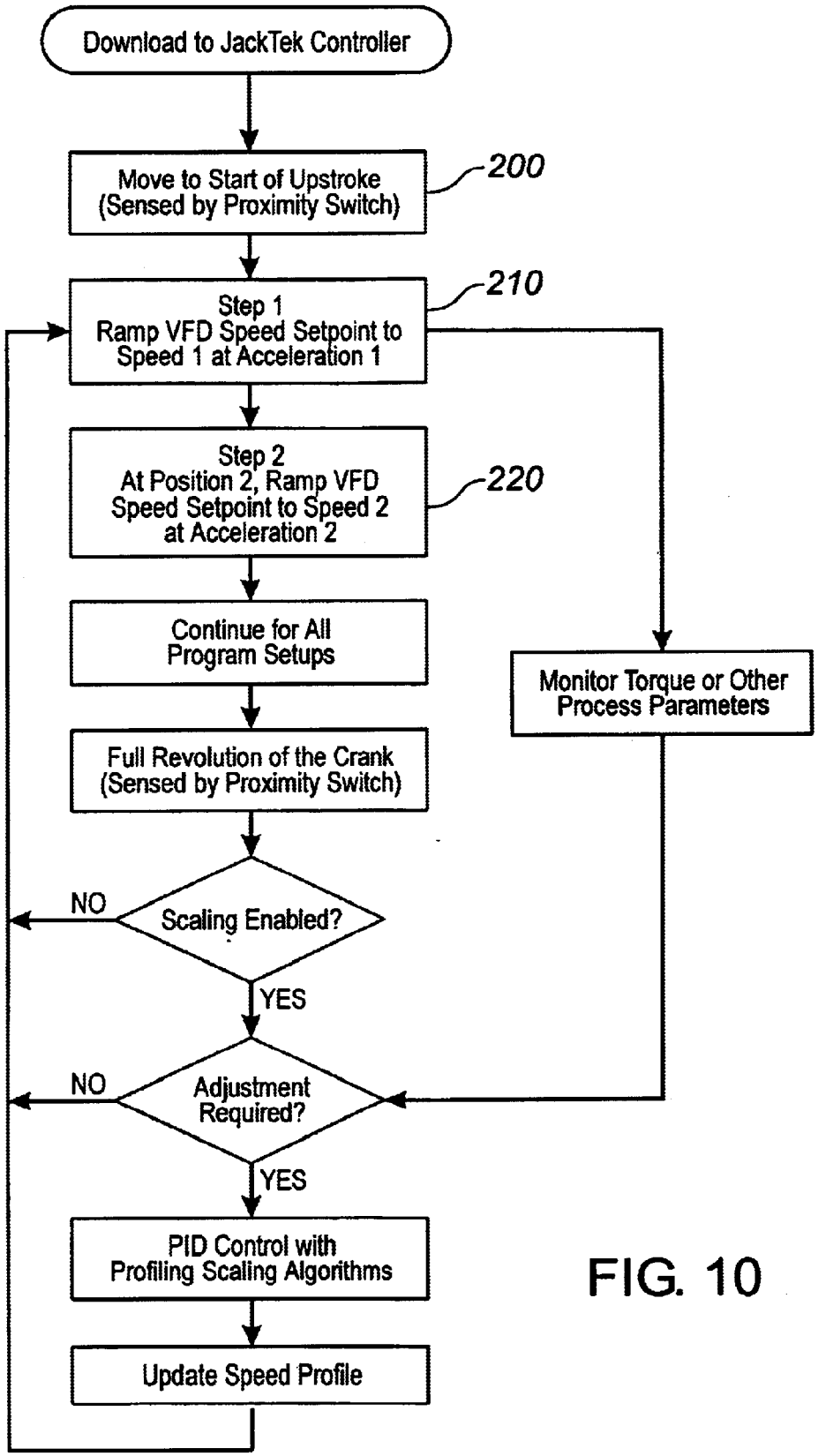
FIG. 10 is a flow diagram of a speed control process.

FIG. 10 demonstrates the operation of the controller. The proximity switch provides a start of cycle signal (200) whereupon the variable frequency chive (VFD) ramps up the crank speed to the desired start speed (210), at the set rate of acceleration. The position of the crank is then estimated using an actual speed reference as described above and the next program step (220) is invoked at the appropriate position. At that position, the VFD speed setpoint is either increased or decreased at the desired acceleration and ibis process is continued for all program steps during the cycle. The proximity switch signals the end of a cycle which is obviously coincidental with the start of the next cycle. At this time, if PID scaling is enabled and an overtorque or rod overload condition was detected during the cycle, the speed setpoints may be scaled back and a new scaled speed profile created for the next cycle. The scaling algorithm may be designed so as to reduce all speed setpoints by a predetermined figure on each cycle until the torque is reduced to an acceptable level, as reported by the torque senior (41). Alternatively, the scaling algorithm may be designed to sense the amount by which the torque value has been exceeded and reduce the speed setpoints by a percentage which aims to reduce torque to an acceptable level in one step. In one alternative embodiment, the scaling algorithms may be designed to scale back only a portion of the cycle, such as the upstroke portion only.

As will be apparent to those skilled in the art, various modifications, adaptations and variations of the foregoing specific disclosure can be made without departing from the scope of the invention claimed herein. The various features and elements of the described invention may be combined in a manner different from the combinations described or claimed herein, without departing from the scope of the invention.

What is claimed is:

1. A control system for varying the rod speed of a pumping unit having a geometry and comprising a variable speed motor and rotating crank arm:

(a) a variable frequency drive for providing a speed setpoint to the motor;

(b) a controller operatively connected to the variable frequency drive comprising means for outputting a speed setpoint in accordance with a crank speed profile which is non-constant within a single cycle; and (c) a processor comprising means for creating a the crank speed profile and communicating the crank speed profile to the controller.

2. The system of claim 1 further comprising a memory including a mathematical representation of the pumping unit geometry and wherein the processor comprises means for creating a rod speed profile and means for converting a rod speed profile to a crank speed profile.

3. The system of claim 2 further comprising means for determining, the position of the crank arm and its speed.

4. The system of claim 3 wherein the determination means comprises a proximity sensor associated with the crank arm which senses the periodic passing of the crank arm and thereupon transmits a signal.

5. The system of claim 4 wherein the variable frequency drive comprises means for producing an actual speed reference which is transmitted to the determination means.

6. The system of claim 1 further comprising a sensor for sensing motor torque and means for scaling a crank speed profile up or down to increase or decrease motor torque.

7. The system of claim 1 further comprising means for creating an actual crank speed profile from the determination of the crank position and speed, means for converting the actual crank speed profile to an actual rod speed profile and means for displaying the actual crank and/or rod speed profile.

8. The system of claim 2 further comprising means for simulating an actual crank speed profile from the desired crank or rod speed profile and displaying the simulated crank speed profile.

9. A method of controlling the rod speed of a pumping unit having a geometry and comprising a variable frequency drive, a variable speed motor and a rotating crank arn, the method comprising the steps of:

(a) creating a mathematical model of the pumping unit geometry;

(b) receiving from a user a rod speed profile or a crank speed profile which is non-constant within a single cycle;

(c) converting a rod speed profile to a crank speed profile which is non-constant within a single cycle using the mathematical model, if a rod speed profile is received; and (d) outputting a speed setpoint to the variable frequency drive in accordance with the crank speed profile.

10. The method of claim 9 further comprising the step of determining the position and speed of the crank arm from an actual speed reference generated by the variable frequency drive.

11. The method of claim 10 further comprising the step of resetting the position of the crank arm once per revolution by means of a proximity switch which senses the passing of the crank arm and thereupon transmits a signal.

12. The method of claim 9 further comprising the step of scaling the crank speed profile up or down in response to a motor torque condition.

13. The method of claim 12 wherein the crank speed profile is scaled up or down at the start of a cycle but not during a cycle.

14. The method of claim 10 further comprising the step of creating and displaying an actual crank or rod speed profile from the determination of the crank arm partition and speed.

* * * * *